US010156169B2

(12) United States Patent
Hashimoto

(10) Patent No.: US 10,156,169 B2
(45) Date of Patent: Dec. 18, 2018

(54) OIL SEPARATOR

(71) Applicant: NIFCO INC., Yokosuka-shi, Kanagawa (JP)

(72) Inventor: Shoichiro Hashimoto, Yokosuka (JP)

( * ) Notice: Subject to any disclaimer, the term of this patent is extended or adjusted under 35 U.S.C. 154(b) by 0 days.

(21) Appl. No.: 15/515,203

(22) PCT Filed: Aug. 7, 2015

(86) PCT No.: PCT/JP2015/003998
§ 371 (c)(1),
(2) Date: Mar. 29, 2017

(87) PCT Pub. No.: WO2016/056159
PCT Pub. Date: Apr. 14, 2016

(65) Prior Publication Data

US 2017/0218804 A1 Aug. 3, 2017

(30) Foreign Application Priority Data

Oct. 6, 2014 (JP) ..... 2014-205571

(51) Int. Cl.
*F01M 13/04* (2006.01)
*F01M 11/08* (2006.01)
(Continued)

(52) U.S. Cl.
CPC ..... *F01M 13/04* (2013.01); *F01M 11/08* (2013.01); *F01M 13/00* (2013.01); *F01M 13/022* (2013.01);
(Continued)

(58) Field of Classification Search
CPC ..... F01M 13/04; F01M 13/022; F01M 2013/0433; F01M 2013/0461
See application file for complete search history.

(56) References Cited

U.S. PATENT DOCUMENTS

2003/0150436 A1 8/2003 Stegmaier et al.
2004/0261776 A1 12/2004 Knaus et al.
(Continued)

FOREIGN PATENT DOCUMENTS

DE 102004061938 B3 6/2006
DE 10362162 B4 4/2008
(Continued)

OTHER PUBLICATIONS

International Search Report for International Application No. PCT/JP2015/003998, dated Nov. 10, 2015, 4 pages.
(Continued)

*Primary Examiner* — Jacob Amick
*Assistant Examiner* — Charles Brauch
(74) *Attorney, Agent, or Firm* — Armstrong Teasdale LLP

(57) ABSTRACT

Provided is an oil separator having a high efficiency in removing oil particles of relatively large sizes. A blow-by gas passage of the oil separator (2) includes an upstream passage (18) and a downstream passage (20) extending at an angle to the upstream passage. A separation wall (36) provided in the downstream passage includes a first surface (40, 78) forming an obtuse angle relative to the upstream passage, and a second surface (42) adjoining the first surface on a downstream side thereof and defining a planar surface extending substantially perpendicularly to the upstream passage. The blow-by gas is accelerated in the upstream passage, and the flow direction of the blow-by gas is changed by the first surface without substantially changing the flow speed and without disturbing the flow before the blow-by gas flows along the second surface. At this time, the oil particles in the blow-by gas collide with and are trapped by the second surface owing to the inertia of the oil particles.

6 Claims, 5 Drawing Sheets

(51) Int. Cl.
*F01M 13/00* (2006.01)
*F01M 13/02* (2006.01)

(52) U.S. Cl.
CPC ..... *F01M 2013/0433* (2013.01); *F01M 2013/0461* (2013.01)

(56) References Cited

U.S. PATENT DOCUMENTS

| | | | | |
|---|---|---|---|---|
| 2007/0181107 | A1* | 8/2007 | Shieh | F01M 13/04 123/572 |
| 2007/0295315 | A1* | 12/2007 | Guerry | F01M 13/04 123/572 |
| 2008/0196364 | A1 | 8/2008 | Brand et al. | |
| 2010/0006075 | A1 | 1/2010 | Ruppel et al. | |
| 2011/0290225 | A1 | 12/2011 | Torella | |
| 2013/0276767 | A1* | 10/2013 | Polichetti | F01M 13/04 123/573 |

FOREIGN PATENT DOCUMENTS

| | | | |
|---|---|---|---|
| EP | 1 870 571 | A2 | 12/2007 |
| EP | 1 870 571 | A3 | 4/2008 |
| JP | H1026012 | A | 1/1998 |
| JP | 2005048601 | A | 2/2005 |
| JP | 2007100567 | A | 4/2007 |
| JP | 2008510925 | A | 4/2008 |
| JP | 2013133779 | A | 7/2013 |
| KR | 20130053887 | A | 5/2013 |

OTHER PUBLICATIONS

Supplementary European Search Report issued in EP 15 84 9253, dated May 16, 2018.

* cited by examiner

OIL SEPARATOR

TECHNICAL FIELD

The present invention relates to an oil separator for separating oil particles in blow-by gas of an internal combustion engine, and in particular to an oil separator suitable for separating relatively large oil particles.

BACKGROUND ART

The blow-by gas that leaks into a crankcase chamber via a gap between a piston and a cylinder of an internal combustion engine such as an automotive engine contains a large amount of hydrocarbons (HC). Hydrocarbons are a known cause of photochemical smog, and it has been widely practiced to return the blow-by gas to the intake system to burn the hydrocarbons with the mixture (blow-by gas recirculation system), instead of releasing the hydrocarbons to the atmosphere. The blow-by gas contains minute particles of engine oil, and it is desired to separate the engine oil to return the engine oil back to the engine. Various different types of oil separators are known such as inertia collision type, labyrinth type and cyclone type.

An inertia collision type oil separator is internally provided with a collision plate that blocks the flow of blow-by gas. When blow-by gas collides with the collision plate, the oil particles contained in the blow-by gas adhere to the collision plate owing to the inertia of the oil particles, and can be collected. Patent Document 1 discloses an inertia collision type oil separator, for instance. In this prior oil separator, a sheet spring that closes an opening of a flow passage is supported in the manner of a cantilever. As the sheet spring resiliently deflects, a gap is created between the opening and the sheet spring. The blow-by gas is accelerated as the blow-by gas flows through this gap, and collides with a wall placed in the downstream part of the flow passage. As a result, the oil particles contained in the blow-by gas adhere to the wall owing to the inertia of the oil particles, and are trapped on the wall. In this oil separator, as the blow-by gas collides with the wall at high speed, even oil particles of relatively small sizes can be trapped.

In a labyrinth type oil separator, a plurality of partition walls are positioned in a flow passage of blow-by gas in the manner of a maze. As a result, the oil particles are forced to travel long distances so that some of the oil particles are caused to drop to the bottom of the flow passage under the gravitational force. Also, as the flow direction of the blow-by gas is changed by the partition walls, the oil particles collide with the partition walls owing to the inertia of the oil particles, and are thereby trapped by the partition walls. Thus, it can be said that a labyrinth type oil separator is incorporated with a mechanism of an inertia collision type oil separator. Patent Document 2 discloses an oil separator of this type. In this prior oil separator, a plurality of projections project from the walls forming a labyrinth passage so that the oil particles in the blow-by gas are caused to collide with these projections, and trapped by these projections. By increasing the area of the part which the oil particles collide with, the efficiency of oil separation can be improved.

PRIOR ART DOCUMENT(S)

Patent Documents (s)

Patent Document 1: DE10362162B4
Patent Document 2: JP2007-100567A

SUMMARY OF THE INVENTION

Task to be Accomplished by the Invention

The oil separator disclosed in Patent Document 1 is suitable for collecting oil particles of relatively small sizes, but has a risk of failure when oil particles of relatively large sizes are contained in the blow-by gas because the oil particles of relatively large sizes may adhere to the sheet spring which defines the small gap through which the blow-by gas is accelerated. Therefore, it is necessary to use an auxiliary oil separator or a pre-separator for removing oil particles of relatively large sizes from the blow-by gas before being introducing the blow-by gas into the main oil separator.

As for the oil separator disclosed in Patent Document 2, there is little risk of failure even when the blow-by gas contains oil particles of relatively large sizes. However, even when used as a pre-separator, oil particles of relatively large sizes cannot be removed in a satisfactory manner.

The present invention was made in view of such problems of the prior art, and has a primary object to provide an oil separator having a high efficiency in removing oil particles of relatively large sizes.

Means for Accomplish the Task

To achieve such an object, the present invention provides an oil separator (2) for removing oil from blow-by gas of an internal combustion engine, comprising: a blow-by gas passage including an upstream passage (18) and a downstream passage (20) connected to a downstream end of the upstream passage and provided with a separation wall (36) for changing a flow direction of the blow-by gas that has passed through the upstream passage; wherein the separation wall includes a first surface (40, 78) opposing the upstream passage, and a second surface (42) adjoining the first surface on a downstream side thereof and defining a planar surface extending substantially perpendicularly to the upstream passage, the first surface defining a planar surface or a concave curved surface more proximate to the upstream passage than a planar extension of the second surface.

The first surface changes the flow direction of the blow-by gas smoothly toward the direction extending along the second surface so that the oil particles are caused to collide with the separation wall owing to the inertia of the oil particles, and the oil particles of relatively large sizes can be effectively separated. This oil separator is particularly suitable for use as a pre-separator positioned on the upstream side of a post-separator which is effective in removing oil particles of relatively small sizes.

According to another aspect of the present invention, the upstream passage includes a pair of side walls (26) having mutually opposing wall surfaces, a rear wall (28) extending to the separation wall and a front wall (30) having a free end opposing the separation wall at a gap, a boundary line (44) between the first surface and the second surface being located more downstream than an intersection line between the separation wall and an extension plane of a rear surface (32) of the front wall.

In this arrangement, the flow direction of the blow-by gas is changed even more smoothly by the first surface so that the pressure loss of the blow-by gas flowing from the upstream passage to the downstream passage can be minimized, and the efficiency of separating oil can be improved.

According to yet another aspect of the present invention, the upstream passage extends vertically, and the second surface of the separation wall positioned below the upstream passage extends substantially horizontally or with a slight downward slant.

In this arrangement, the separated oil does not flow against the flow of the blow-by gas so that the oil is prevented from being entrained into the blow-by gas.

According to yet another aspect of the present invention, the oil separator further includes a drain (24) provided adjacent to a downstream side of the second surface for returning the oil separated from the blow-by gas by the separation wall to a crankcase chamber.

This arrangement allows the separated oil to be quickly expelled from the flow passage of the blow-by gas.

According to yet another aspect of the present invention, the oil separator further includes a stepped surface (52) extending substantially perpendicularly to an extension plane of the second surface on a downstream side of the drain, and projecting more inward into the downstream passage than the second surface.

The oil particles of relatively large sizes which failed to be separated by the separation wall can be separated by the stepped surface so that the efficiency of collecting oil particles of relatively large sizes can be improved.

According to yet another aspect of the present invention, the stepped surface is provided immediately downstream of and above the drain.

In this arrangement, the oil that is separated by the stepped surface is expelled from the flow passage of the blow-by gas under the gravitational force.

BRIEF DESCRIPTION OF THE DRAWING(S)

DESCRIPTION OF THE PREFERRED EMBODIMENT(S)

Figure 1:
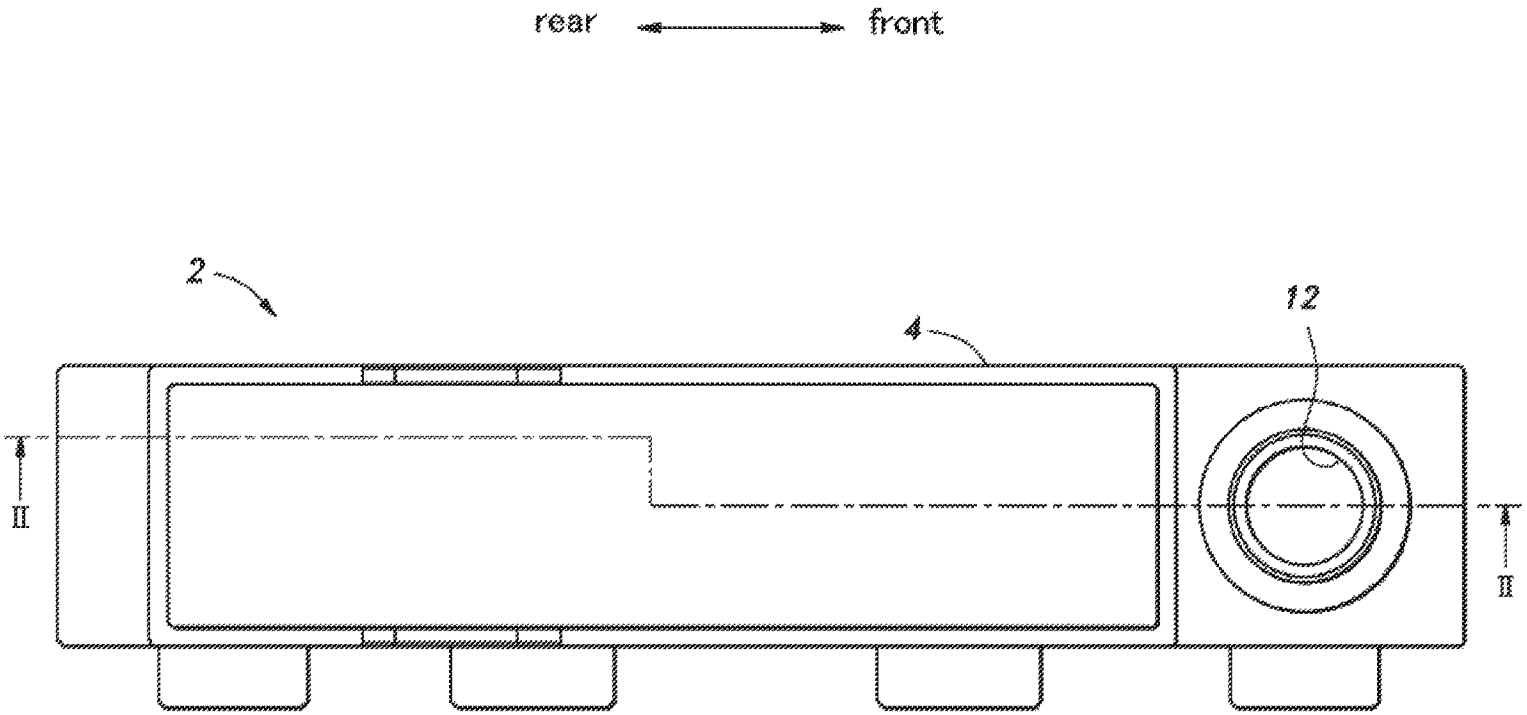
FIG. 1 is a plan view of an oil separator embodying the present invention.

An embodiment of the present invention is described in the following with reference to the appended drawings. The terms indicating various directions in the following description are defined on the basis of the respective drawings.

In a blow-by recirculation system of an automotive engine not shown in the drawings, an oil separator 2 is used for separating oil (oil particles) from the blow-by gas, and is provided integrally with or separately from a head cover provided in an upper part of the engine.

Figure 2:
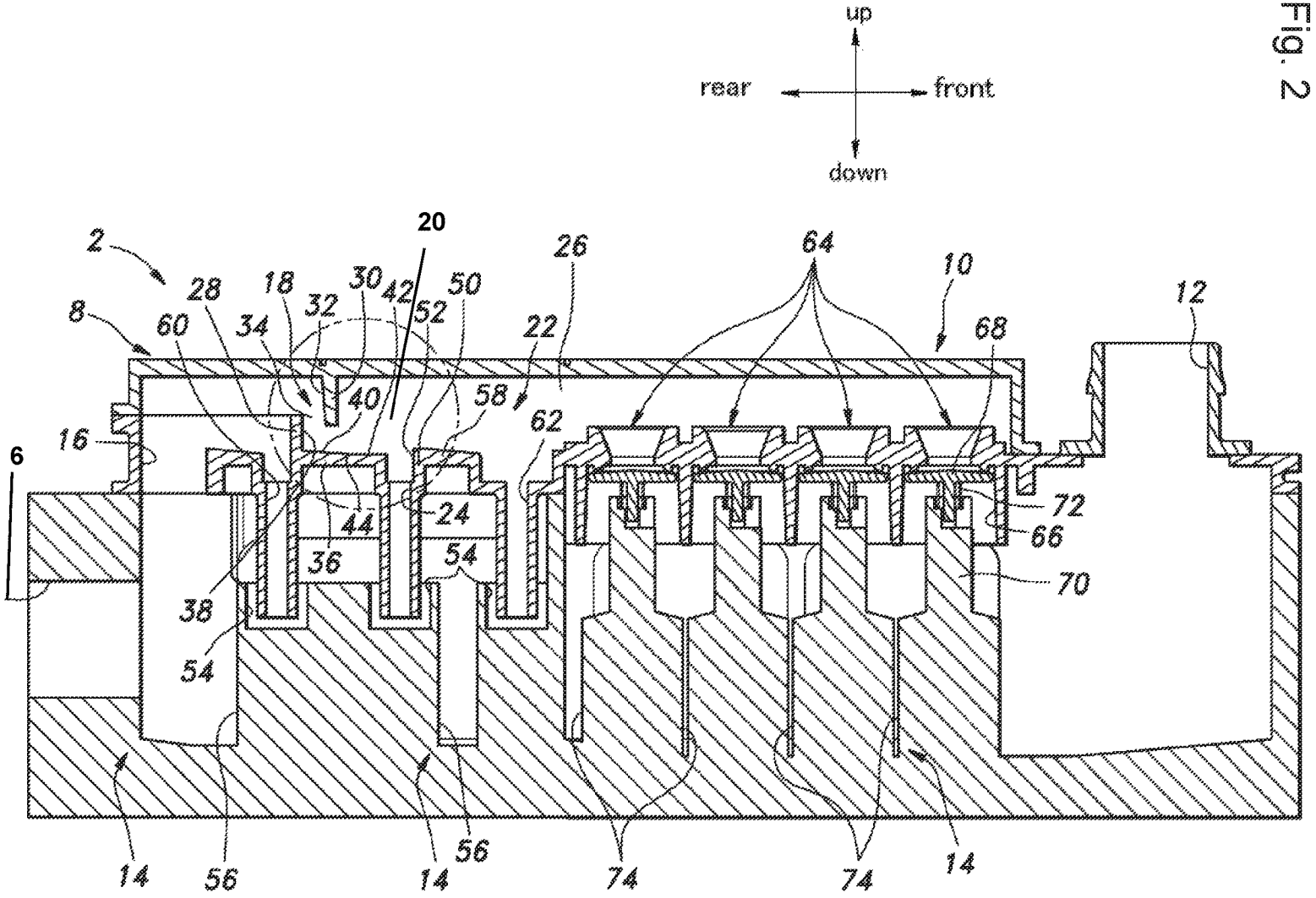
FIG. 2 is a sectional view taken along line II-II of FIG. 1.

Referring to FIGS. 1 and 2, the oil separator 2 includes a case 4 internally formed with an inlet 6 for introducing blow-by gas, a pre-separator unit 8 for removing oil particles of relatively small sizes, a post-separator unit 10 for removing oil particles of relatively large sizes, and an outlet 12 for expelling the blow-gas to outside, in that order from left (upstream side) to right (downstream side). The case 4 is further formed with an oil return system 14 for returning the oil collected in the pre-separator unit 8 and the post-separator unit 10 to a crankcase chamber not shown in the drawings. The case 4 may be made of plastic or metallic material, and is provided with a generally rectangular configuration.

The inlet 6 communicates with the crankcase chamber so that the blow-by gas in the crankcase chamber is introduced into the pre-separator unit 8.

The pre-separator unit 8 includes an inlet part 16 for admitting the blow-by gas introduced from the inlet 6, an upstream passage 18 for accelerating the blow-by gas from the inlet part 16 in a prescribed direction, a downstream passage 20 for separating oil particles from the accelerated blow-by gas, a communication part 22 for conducting the blow-by gas from the downstream passage 20 to the post-separator unit 10, and a drain 24 forming the oil return system 14 on the side of the pre-separator unit 8. The passage for the blow-by gas in the pre-separator unit 8 is defined by a pair of case side walls 26 and a plurality of fixed walls extending between the two case side walls 26.

Figure 3:
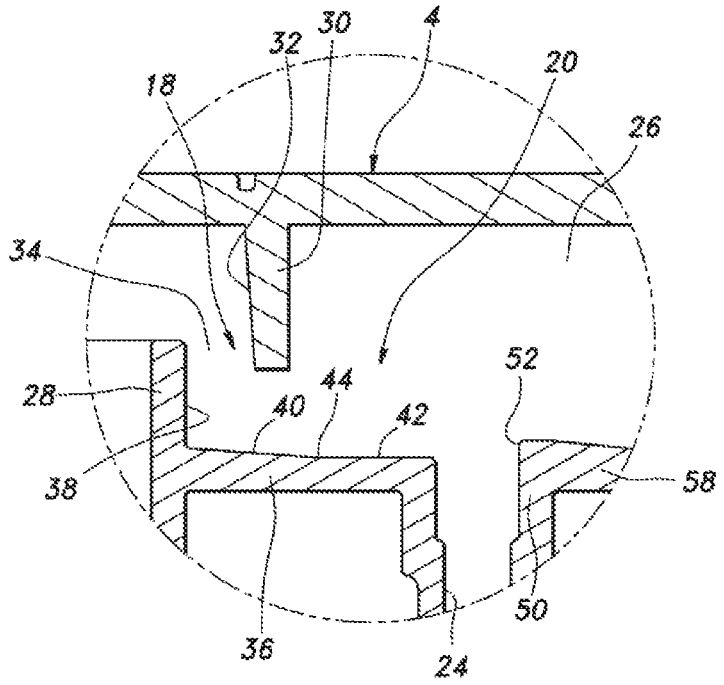
FIG. 3 is an enlarged sectional view of a main part of the oil separator.

Referring to FIG. 3, the upstream passage 18 is defined by a rear wall 28 and a front wall 30 extending between the two case side walls 26. The rear wall 28 extends vertically from the bottom surface of the case 4 so as to have a major plane generally facing the fore and aft direction. The free end of the rear wall 28 opposes the inner surface of the upper wall of the case 4 at a certain gap. The front wall 30 is positioned in front of the rear wall 28 or horizontally downstream of the rear wall 28 with respect to the flow of the blow-by gas, and projects vertically downward from the inner surface of the upper wall of the case 4 so as to have a major plane generally facing the fore and aft direction. The free end of the rear wall 28 and the free end of the front wall 30 oppose each other. A rear surface 32 of the front wall 30 defining a part of the upstream passage 18 is planar, and extending substantially in the vertical direction, but may also be slanted in the forward direction toward the lower end thereof. A rectangular annular passage defined by the two case side walls 26, the free end side of the rear wall 28 and the free end side of the front wall 30 defines a narrowed portion 34 which is narrowed relative to the parts that are immediately upstream and downstream of the narrowed portion 34.

The downstream passage 20 adjoins the lower end of the upstream passage 18. A part of the downstream passage 20 is defined by a separation wall 36 that changes the flow direction of the blow-by gas which has passed through the upstream passage 18 by about 90 degrees. The separation wall 36 extends from an intermediate part of a front surface 38 of the rear wall 28 in the forward direction so as to have a wall surface generally facing upward. The extending direction of the separation wall 36 is substantially orthogonal to the rear wall 28. The upper surface of the separation wall 36 opposes the free end of the front wall 30 at a certain gap. The upper surface of the separation wall 36 consists of a first surface 40 on the upstream side and a second surface 42 on the downstream side.

The first surface 40 of the separation wall 36 is planar, and forms an obtuse angle relative to the upstream passage 18. In other words, a plane defined by the extension of each of the front surface 38 of the rear wall 28 and the rear surface 32 of the front wall 30 forms an obtuse angle with respect to a plane of the first surface 40 of the separation wall 36 extending from the intersection line between the corresponding plane in the downstream direction. Also, the first surface 40 extends further in the downstream direction than the intersection line between the first surface 40 and the extension plane of the rear surface 32 of the front wall 30. In other words, the boundary line 44 between the first surface 40 and the second surface 42 is located more downstream than the intersection line between the separation wall 36 and the extension plane of the rear surface 32 of the front wall 30. The second surface 42 of the separation wall 36 is planar, and adjoins the downstream end of the first surface 40. The second surface 42 is substantially horizontal, but may also slant slightly downward toward the downstream side thereof. The angle formed between the first surface 40 and the second surface 42 may be in the range of 135 to 177 degrees. In other words, the extension plane drawn from the second surface 42 in the upstream direction may form an angle of 3 to 45 degrees with respect to the second surface 42. The boundary line 44 extends linearly in a direction orthogonal to the paper sheet of FIG. 3. Therefore, the extension plane of the second surface 42 is substantially orthogonal to the extension direction of the upstream passage 18, and the first surface 40 is deflected with respect to the second surface 42 so as to be closer to the upstream passage 18 than the extension plane of the second surface 42.

A drain 24 is provided immediately downstream of the separation wall 36 in a downwardly extending manner for returning the oil separated from the blow-by gas to the crankcase chamber. The drain 24 is tubular in shape, and extends vertically. A stepped wall 50 having a major plane which is substantially orthogonal to the flow passage of the blow-by gas rises upward immediately downstream of the drain 24. The upper end of the stepped wall 50 protrudes slightly upward than the extension plane of the second surface 42 of the separation wall 36 so that a stepped surface 52 higher than the second surface 42 is formed. The upper end of the stepped surface 52 is lower than the free end of the rear wall 28 and the free end of the front wall 30. The drain 24 is connected to the second surface 42 and the stepped surface 52 via smooth wall surfaces, and are positioned such that the oil that has deposited on the second surface 42 and the stepped surface 52 flows into the drain 24 owing to the flow of the blow-by gas or the gravitational force.

The lower end of the drain 24 is received in a recess 54 in a spaced apart relationship, and a groove 56 is formed adjacent to the recess 54 so that the oil overflowing from the recess 54 is returned to the crankcase chamber via the groove 56. The recess 54 and the groove 56 are formed so as to have upper opening planes that are at a same elevation.

The communication part 22 is located on the downstream side of the stepped surface 52 in order to conduct the blow-by gas to the post-separator unit 10. The communication part 22 is defined by a bottom wall 58 extending in the downstream direction from the stepped surface 52, and the upper wall and other parts of the case 4 located more forward than the front wall 30. The upper surface of the bottom wall 58 slants downward toward the front part thereof.

The inlet part 16 and the communication part 22 are provided with sub drains 60 and 62 for expelling the oil separated in the inlet part 16 and the communication part 22, respectively. The rear wall 28 stands upright from a part immediately downstream of the sub drain 60 of the inlet part 16. The sub drain 62 of the communication part 22 is located in front of the bottom wall 58. The sub drains 60 and 62 are tubular in shape, and extend vertically with the lower ends received in respective recesses 54 in a spaced apart relationship, similarly as the drain 24. These recesses 54 receiving the sub drains 60 and 62 also adjoined by the groove 56.

The post-separator unit 10 receives the blow-by gas that has passed through the pre-separator unit 8, and removes primarily oil particles of smaller sizes than those separated by the pre-separator unit 8.

As shown in FIG. 2, in the post-separator unit 10, the flow passage is forked into four parallel branch passages each having a small oil particle removable mechanism 64 of a substantially same structure. The blow-by gas flows substantially downward through the small oil particle removable mechanisms 64. The branch passages merge into a single flow passage so that the blow-by gas that has passed through the small oil particle removable mechanisms 64 merges into a single flow.

Referring to FIG. 2, each small oil particle removable mechanism 64 includes a vertically extending cylinder 66, a valve member 68 vertically moveably received in the cylinder 66, a support member 70 vertically moveably supporting the valve member 68, and a spring member 72 urging the valve member 68 upward. A recovery groove 74 serving as a part of the oil return system 14 is provided under each small oil particle removable mechanism 64.

Figure 4:
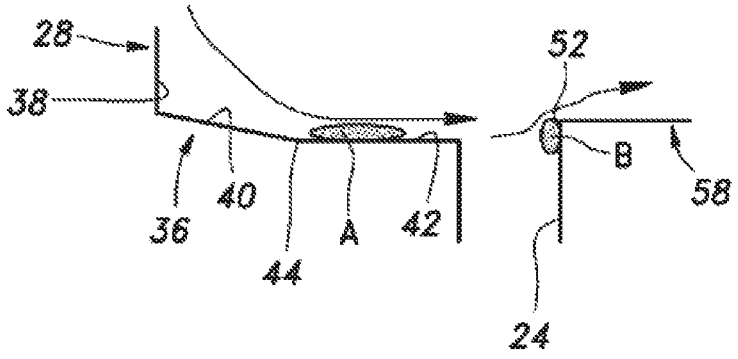
FIG. 4 is a conceptual view illustrating the operation of the oil separator.

The mode of operation of the oil separator 2 is described in the following. As shown in FIG. 4, in the pre-separator unit 8, the oil particles in the blow-by gas is separated primarily by the separation wall 36 and the stepped surface 52. The arrows in FIG. 4 indicate the flow of the blow-by gas.

The blow-by gas that has flowed into the upstream passage 18 from the inlet part 16 is accelerated by the narrowed portion 34, and is directed downward or in a forwardly downward direction. It is believed that, owing to the presence of the first surface 40 forming an obtuse angle relative to the upstream passage 18 and the second surface 42 of the separation wall 36, the blow-by gas is directed smoothly in the direction extending along the second surface 42 without being disturbed while the flow speed thereof is substantially maintained during this process. However, this theory should not be construed as limiting the present invention. At this time, the oil particles of relatively large sizes which have greater masses than other components of the blow-by gas are directed more downward than the other components. As a result, the oil particles of relatively large sizes collide with the second surface 42, and separated by being trapped by the second surface 42. The oil A separated on the second surface 42 flows into the drain 24 by being pushed by the flow of the blow-by gas or under its own weight.

The blow-by gas that has flowed along the second surface 42 is deflected upward owing to the presence of the stepped surface 52 located on the downstream side thereof. The oil particles of relatively large sizes which failed to be separated by the separation wall 36 collide with the stepped surface 52, and are separated from the blow-by gas by being trapped by the stepped surface 52 because the oil particles have a greater mass than the other components of the blow-by gas, and are hence subjected to a greater inertia. The oil B separated by the stepped surface 52 flows into the drain 24 under its own weight.

The oil A and B trapped by the second surface 42 and the stepped surface 52 is passed into the drain 24, and is thence returned to the crankcase chamber via the recess 54 and the groove 56. Also, similarly as the conventional labyrinth oil separator, oil is separated by being deposited on the wall surfaces of the inlet part 16 and the communication part 22 and dropping to the bottom under its own weight, and the separated oil is returned to the crankcase chamber via the sub drains 60 and 62, the recesses 54 and the groove 56.

As shown in FIG. 2, in the post-separator unit 10, when a pressure difference between the crankcase chamber side and the intake system side becomes significant, the pressure difference overcomes the biasing force of the spring member 72 so that the valve member 68 moves downward until the upper end surface of the valve member 68 is displaced away from the shoulder surface defined on the upstream side of the cylinder 66, thereby opening the passage for the blow-by gas.

The blow-by gas traveling at high speed after passing through the gap between the upper end surface of the valve member 68 and the shoulder surface in the upper end part of the cylinder 66 collides with the inner circumferential surface of the cylinder 66. The speed of the blow-by gas that collides with the inner circumferential surface of the cylinder 66 is far greater than that of the blow-by gas in the pre-separator unit 8. Therefore, even the oil particles of relatively small sizes can be trapped on the inner circumferential surface of the cylinder 66 owing to the inertia thereof. The blow-by gas that has passed through the cylinder 66 flows to the outlet 12 while the oil trapped on the inner circumferential surface of the cylinder 66 drops into the recovery groove 74 located below to be returned to the crankcase chamber.

As the pre-separator unit 8 is designed to separate oil particles of relatively large sizes, the narrowed portion 34 is wide enough not to be clogged by oil. As the flow passage of the pre-separator unit 8 is defined solely by fixed walls, and moving parts which are prone to failure are not used, there is no risk of failure. By suitably selecting the sizes and positions of the narrowed portion 34, the separation wall 36 and the stepped surface 52, oil particles greater than a prescribed size can be substantially entirely separated from the blow-by gas. Also, only one set of the narrowed portion 34, the separation wall 36 and the stepped surface 52 is required to be provided in the pre-separator unit 8 for oil particles having sizes greater than a prescribed size to be substantially entirely eliminated. Therefore, the pressure loss of the blow-by gas can be minimized, the length of the flow passage for the blow-by gas can be minimized, and the size of the oil separator 2 can be minimized.

Because the oil particles of large sizes have been trapped by the pre-separator unit 8, the post-separator unit 10 is required to trap only the oil particles of large sizes. Therefore, even when the flow passage is narrowed so as to accelerate the flow of the blow-by gas, clogging of the flow passage by the oil can be avoided or minimized.

Figure 5:
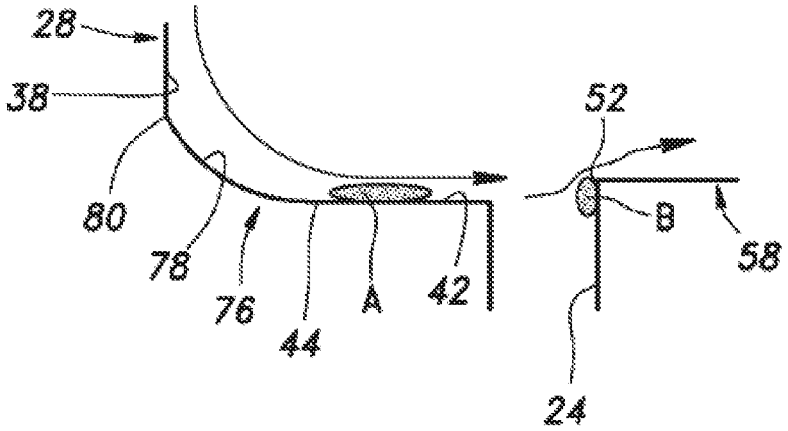
FIG. 5 is a conceptual view illustrating the operation of an oil separator of a modified embodiment.

A modified embodiment of the present invention is described in the following with reference to FIG. 5. In the following description, the parts corresponding to those of the foregoing embodiment are denoted with like numerals without necessarily repeating the description of such parts. The modified embodiment differs from the foregoing embodiment only in the configuration of the first surface 78 of the separation wall 76.

The first surface 78 consists of a concave curved surface which is connected to the rear wall 28 at a boundary line 80 and the second surface 42 at a boundary line 44. In the cross sectional view of FIG. 5, the tangential line of the surface 78 at the boundary line 80 with the rear wall 28 drawn in the downstream direction forms an obtuse angle relative to the upstream passage 18 (see FIG. 3). The tangential line of the first surface 78 at the boundary line 44 with the second surface 42 substantially coincides with the extending direction of the second surface 42.

Regarding this modified embodiment also, it is believed that, owing to the presence of the first surface 78 forming an obtuse angle relative to the upstream passage 18 and connected to the second surface 42 of the separation wall 36 in a smoothly continuous manner, the blow-by gas is directed smoothly in the direction extending along the second surface 42 without being disturbed while the flow speed thereof is substantially maintained during this process. However, this theory should not be construed as limiting the present invention. At this time, the oil particles of relatively large sizes which have greater masses than other components of the blow-by gas are directed more downward than the other components. As a result, the oil particles of relatively large sizes collide with the second surface 42, and are separated by being trapped by the second surface 42 owing to the action of the inertia.

Although the present invention has been described in terms of a preferred embodiment thereof, it is obvious to a person skilled in the art that various alterations and modifications are possible without departing from the scope of the present invention. For instance, the pre-separator unit may also be used as an independent oil separator. The orientation of the oil separator is not limited by the illustrated embodiment, but may be altered freely as long as the separated oil is conducted to the drain under its own weight or by the flow of the blow-by gas. Instead of providing the narrowed portion in the upstream passage, the cross sectional area of the upstream passage may be made substantially constant from the inlet onward.

GLOSSARY OF TERMS

| | | | |
|---|---|---|---|
| 2 | oil separator | 8 | pre-separator unit |
| 18 | upstream passage | 20 | downstream passage |
| 24 | drain | 28 | rear wall |
| 30 | front wall | 32 | rear surface of front wall |
| 36, 37 | separation wall | 40, 78 | first surface |
| 42 | second surface | | |
| 44 | boundary line between first surface and second surface | | |
| 52 | stepped surface | | |

The invention claimed is:

1. An oil separator for removing oil from blow-by gas of an internal combustion engine, comprising:

a blow-by gas passage including an upstream passage and a downstream passage connected to a downstream end of the upstream passage and provided with a separation wall for changing a flow direction of the blow-by gas that has passed through the upstream passage;

wherein the separation wall includes a first surface opposing the upstream passage, and a second surface continuous with the first surface on a downstream side of the first surface and defining a planar surface extending substantially perpendicularly to the upstream passage, the first surface defining a planar surface or a concave curved surface more proximate to the upstream passage than a planar extension of the second surface, wherein the upstream passage includes a pair of side walls having mutually opposing wall surfaces, a rear wall extending to the separation wall and a front wall having a free end opposing the separation wall at a gap, a boundary line between the first surface and the second surface being located more downstream than an intersection line between the separation wall and an extension plane of a rear surface of the front wall.

2. The oil separator according to claim 1, wherein, the upstream passage extends vertically, and the second surface of the separation wall positioned below the upstream passage extends substantially horizontally or with a slight downward slant.

3. The oil separator according to claim 2, further including a drain provided adjacent to a downstream side of the second surface for returning the oil separated from the blow-by gas by the separation wall to a crankcase chamber.

4. The oil separator according to claim 3, further including a stepped surface extending substantially perpendicularly to an extension plane of the second surface on a downstream side of the drain, and projecting more inward into the downstream passage than the second surface.

5. The oil separator according to claim 4, wherein the stepped surface is provided immediately downstream of and above the drain.

6. The oil separator according to claim 1, wherein the first surface comprises a planar surface forming an angle in a range of 135 to 177 degrees relative to the second surface.

* * * * *